United States Patent [19]

Smith

[11] 4,339,733

[45] Jul. 13, 1982

[54] RADIATING CABLE

[75] Inventor: Kenneth I. Smith, Lubec, Me.

[73] Assignee: Times Fiber Communications, Inc., Wallingford, Conn.

[21] Appl. No.: 184,527

[22] Filed: Sep. 5, 1980

[51] Int. Cl.[3] ..... H01P 3/06

[52] U.S. Cl. ..... 333/237; 333/244

[58] Field of Search ..... 333/237; 343/771

[56] References Cited

U.S. PATENT DOCUMENTS 3,417,400 12/1968 Black ..... 343/771

4,129,841 12/1978 Hildebrand et al. .

FOREIGN PATENT DOCUMENTS 1079504 6/1980 Canada .

45-32964 of 1970 Japan ..... 333/237

*Primary Examiner*—Paul L. Gensler

*Attorney, Agent, or Firm*—Bacon & Thomas

[57] ABSTRACT

The subject invention is directed to a radiating cable comprising at least one center conductor, a dielectric core surrounding said conductor and a plurality of radiating sheaths disposed in coaxial relationship to said at least one center conductor along the length of said dielectric core. The cable design minimizes attenuation of the internal TEM signal and reduces the environmental sensitivity of the cable.

9 Claims, 11 Drawing Figures

RADIATING CABLE

BACKGROUND OF THE INVENTION

1. Field of the Invention

The present invention is directed to an improved radiating cable having utility as transmitting and receiving antennas and as transmission lines.

2. Description of the Prior Art

Numerous types of radiating cables exist. Generally, they may be categorized as radiating coaxial cables or bifilar cables. The bifilar cables are unshielded and the radiating coaxial cables contain various types of apertures in the outer conductor to allow radiation. The apertured outer conductors are referred to as radiating sheaths and provide the means for coupling radio frequency energy between the path inside the sheath and the path outside the sheath. Some radiating coaxial cables additionally employ field perturbing elements which disturb the exciting field within the transmission line so as to enhance the radiating field, inductive elements for increasing the inductance of the outer conductor or drain wires which are laid over or under the outer conductor(s) and function as a ground connection. Such elements do not function as radiating sheaths since they do not serve to couple radio frequency energy between the paths inside and outside their position in the cable.

Many workers in the art have measured the performance of radiating coaxial cables and have found that they behave very similarly. Based upon these studies it has been determined that in order to obtain the desired radiation intensity, the apertures in the outer conductor must be so large that the attenuation of the propagation of the internal TEM signal increases dramatically along the transmission line and in some cases may even be fifteen times greater than that observed from a similar coaxial cable without apertures. However, even this high degree of attenuation is a significant improvement over bifilar radiating cables. As is well known, such attenuation severely limits the length that unamplified signals can be transmitted along the cable.

It is also known that the intensity of radiation from existing radiating cables, be they bifilar or coaxial, is dependent upon the environment of installation, i.e., underground, underwater, aboveground, etc. Here again, coaxial radiating cable out performs bifilar cable but remains environmentally sensitive.

A further problem which plagues coaxial radiating cable results from moisture ingression through the radiating apertures.

SUMMARY OF THE INVENTION

In view of these and other disadvantages and deficiencies in existing radiating cables, it is an object of the present invention to provide an improved radiating cable which eliminates or minimizes degrading environment effects on the performance of the cable and which significantly decreases attenuation along the transmission line.

Still another object of the invention is to decrease the problem of moisture ingression in the radiating cable.

Other objects and advantages of the invention will be apparent to those of skill in the art upon review of the detailed description contained herein.

These objects and advantages are achieved by an improved radiating cable comprised of at least one center conductor, surrounded by a dielectric core and containing a plurality of radiating sheaths disposed along the length of said dielectric core. Virtually all types and numbers of dielectrics, center conductors and radiating sheaths known to those of skill in the art may be used in the radiating cable of the invention.

Thus, there may be more than one center conductor which may be disposed as a straight cylindrical wire or in a helical or twisted arrangement within the dielectric core. Any of the various known materials for constructing center conductors in coaxial cable may be employed, such as, copper, aluminum and copper-clad aluminum, etc.

The dielectric core which surrounds the center conductor and separates it from the inner coaxial radiating sheath may be composed of air, a polymer material such as polytetrafluoroethylene or polyethylene (foamed or unfoamed), laminates and any other material or combination of materials conventionally employed as dielectrics in coaxial cables.

The radiating sheaths disposed along the length of the dielectric core are preferably positioned so as to be coaxial with the central longitudinal axis of the cable. The center conductor or conductors may be concentric or eccentric with the radiating sheaths depending upon their position within the dielectric core. Thus, for example, in a cable having a single center conductor positioned along the central longitudinal axis of the cable, the conductor will be concentric (e.g. coaxial) with the radiating sheaths.

The radiating sheaths may be constructed from any conventional material used as outer conductors in coaxial cables, preferably metals such as copper or aluminum or metal laminates, having apertures or other means to permit radiation. The sheaths may be in the form of braids, helically or longitudinally wrapped structures such as tapes, ribbon or wire, or tubular structures with or without apertures, and may be flat or corrugated. The apertures may be simply holes or gaps in the sheath or they may exist as virtual apertures which are areas of relatively high resistance in the sheath. The apertures may be formed from a dielectric material in addition to or instead of air and they may have a dissimilar material mounted in them such as a ferrite material. The longitudinal or circumferential spacing of the apertures may be periodic or random. Additionally, the apertures may have perturbing elements associated with them. The radiating sheaths may be insulated from each other by an intermediate dielectric layer or they may be in electric contact. Virtually all types of dielectrics known to those of skill in the art may be used as the insulation between the sheaths. It is also possible to bond the sheaths to the adjacent parts of the cable using, for example, an ethylene-acrylic acid copolymer cement.

Each radiating sheath may be constructed differently. Also, the radiating sheath may use means other than apertures for coupling radio frequency energy through the sheath such as helically wrapped structures where the inductance of the helix creates the coupling or a solid sheath which has a thickness sufficiently less than the penetration of the current (skin depth) to allow coupling.

One or more of the radiating sheaths may be graded, that is, constructed such that the coupling of energy will increase along its length. Grading can be used to compensate for the attenuation of the signal within the cable, creating a constant average external field strength or for obtaining any desired field strength variation along the length of the sheath. Grading may be achieved by varying the construction of the center conductor, dielectrics, jacket, radiating sheaths and/or insulation.

The cable may be encased in a protective outer jacket as is well known in the art. Also, if desired, strengthening members, drain wires, inductance elements and messengers may be included in the cable.

The thickness of the various layers is not critical and may be selected to achieve a variety of purposes, such as, manufacturing ease, or particular performance characteristics. Hence, the exemplary and preferred thicknesses recited herein should not be construed to limit the scope of the invention.

In preparing the cable of the invention, the dielectric core is extruded, taped, wound or applied in any other known manner over the center conductor or conductors. The first radiating sheath is then helically wound, longitudinally pulled (cigarette-wrapped), braided, extruded, plated or applied in any other known manner over the dielectric core. Any intermediate dielectric layers are then extruded, wound, taped or applied in any other known manner over the radiating sheath and the second radiating sheath is placed over this. This procedure continues until the desired combination of radiating sheaths is in place. The cable can be unjacketed or a protective outer jacket may be wound, extruded, taped or applied in any other known manner over the structure. Further details of the manufacture of preferred embodiments of the invention are discussed, infra.

BRIEF DESCRIPTION OF THE FIGURES OF DRAWING

DETAILED DESCRIPTION OF THE PREFERRED EMBODIMENTS

Figure 1:
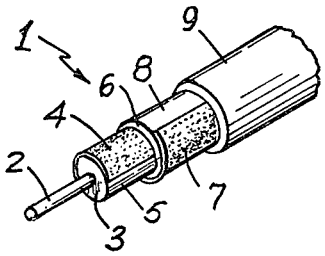
FIG. 1 depicts a cable designed in accordance with the invention in which layers have been partially cut away for illustration.
Figure 2:
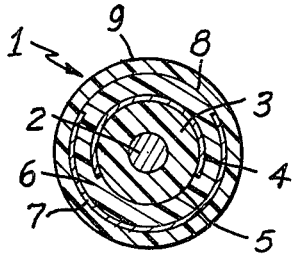
FIG. 2 is a cross section of the cable depicted in FIG. 1.

The figures of drawing illustrate several preferred embodiments of the invention. FIGS. 1 and 2, which represent the most preferred embodiment, depict a triaxial radiating cable 1 comprised of a center conductor 2, which is preferably a copper-clad aluminum wire, surrounded by a cylindrical layer of dielectric material 3, which is preferably unfoamed polyethylene. The inner coaxial radiating sheath 4 is a relatively thin metal foil or tape which is longitudinally pulled (cigarette-wrapped) over the dielectric 3, leaving a longitudinal gap 5 where a portion of the dielectric is exposed. An intermediate dielectric layer 6 is extruded over the radiating sheath 4 and longitudinal gap 5. Here again, unfoamed polyethylene is the preferred dielectric material. The outer coaxial radiating sheath 7 is longitudinally pulled (cigarette-wrapped) over the intermediate dielectric, leaving a longitudinal gap 8 exposing a portion of the intermediate dielectric. As shown in FIG. 2, it is preferred that the two longitudinal gaps in the radiating sheaths be positioned on directly opposite sides of the cable. The widths of the longitudinal gaps and the thickness of the insulation between the sheaths are selected to achieve the desired radiation characteristics in the cable and may be equal or different. The width of the metal tape is selected to provide the desired longitudinal gap for the radiating sheaths, and so will vary with the circumference of the dielectric core. For example, in a cable having a dielectric core approximately 0.5 in. in diameter, metal tapes ranging from 0.75 to 1.375 in. are preferred, in forming the radiating sheaths. Outer jacket 9, which is extruded over the outer radiating sheath 7 and longitudinal gap 8, completes the assembly. The jacket material is preferably polyethylene.

Figure 4:
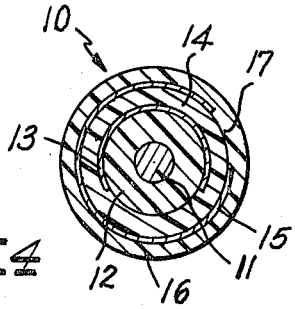
FIG. 4 is a cross section of the cable depicted in FIG. 3.
Figure 3:
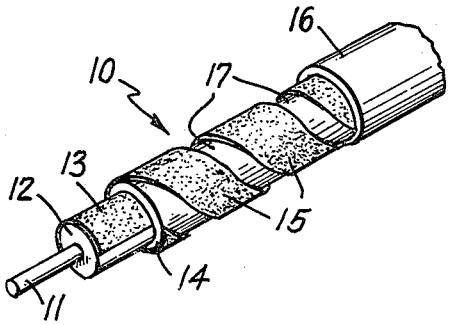
FIG. 3 depicts a second cable designed in accordance with the invention in which layers have been partially cut away for illustration.

FIGS. 3 and 4 show another triaxial radiating cable 10, comprised of center conductor 11, dielectric 12, inner coaxial radiating sheath 13, intermediate dielectric 14, outer coaxial radiating sheath 15 and outer jacket 16. This cable is constructed in the same manner as the cable of FIGS. 1 and 2 with the exception that outer coaxial radiating sheath 15 is a helically wound metal tape having helical gaps 17 where the underlying intermediate dielectric is exposed. Here again, the width of the helical and longitudinal gaps and the thickness of the insulation between the sheaths, are selected to achieve the desired radiation characteristics.

Figure 5:
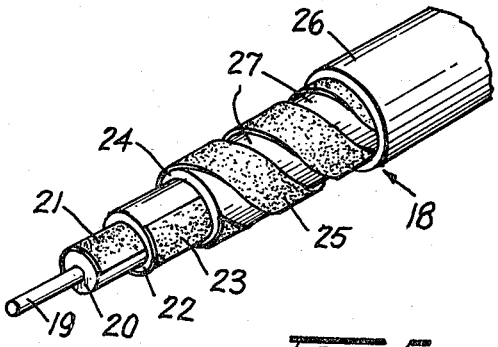
FIG. 5 depicts a third cable designed in accordance with the invention in which layers have been partially cut away for illustration.
Figure 6:
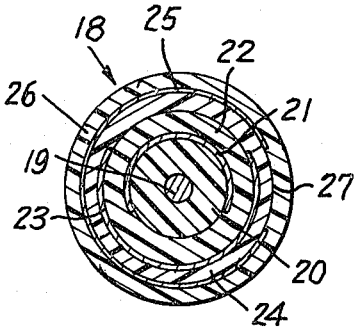
FIG. 6 is a cross section of the cable depicted in FIG. 5.

FIGS. 5 and 6 illustrate a quadraxial cable prepared in accordance with the invention. The cable 18, is seen to be composed of a center conductor 19, surrounded by dielectric 20 and first and second radiating sheaths 21 and 23, separated by intermediate dielectric 22. It is apparent that up to this point the cable is identical to the triaxial cable pictured in FIGS. 1 and 2. However, before the outer jacket 26 is supplied to complete the assembly, an outer dielectric layer 24 and third radiating sheath 25 are provided. As shown in FIG. 5, in this embodiment the third radiating sheath is a helically wound tape having longitudinal gaps 27 exposing a portion of the outer dielectric.

FIGS. 7–11 illustrate other cable designs in accordance with the invention. The elements identified by the reference numerals with primes (') in these figures correspond to the elements having the same reference numeral in FIGS. 1–6.

Figure 7:
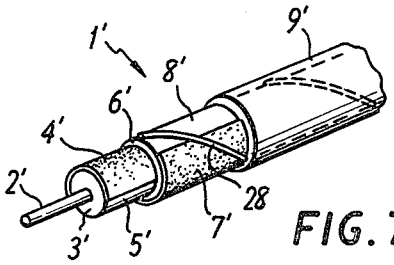
FIG. 7 depicts a cable designed in accordance with the invention in which layers have been partially cut away for illustration, which includes a perturbing element.
Figure 8:
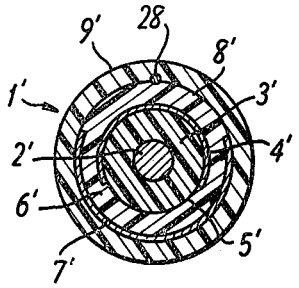
FIG. 8 is a cross section of the cable depicted in FIG. 7.
Figure 9:
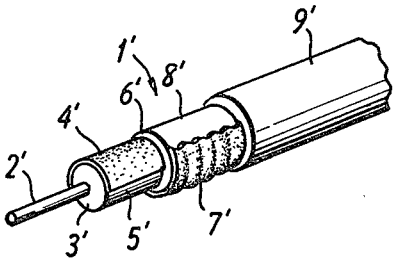
FIG. 9 depicts a cable designed in accordance with the invention in which layers have been partially cut away for illustration, which includes a corrugated radiating sheath.

FIGS. 7, 8 and 9 illustrate essentially the same cable depicted in FIGS. 1 and 2 with the addition of perturbing element 28 in FIGS. 7 and 8 and the use of a corrugated radiating sheath 7' in FIG. 9.

Figure 10:
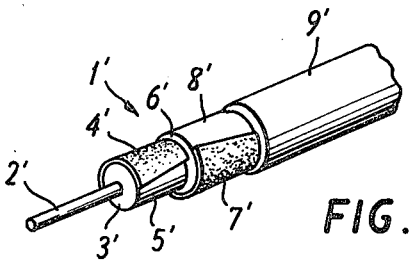
FIGS. 10 and 11 depict cables designed in accordance with the invention in which layers have been partially cut away for illustration, in which the radiating sheaths are graded.
Figure 11:
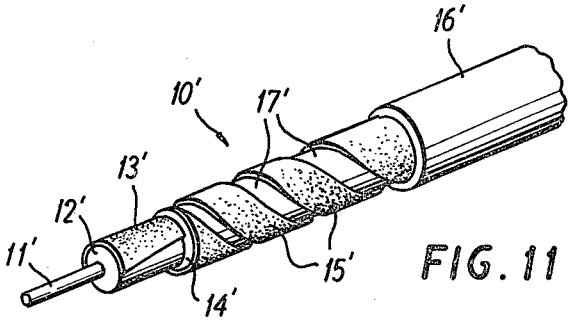

FIGS. 10 and 11 illustrate the use of graded radiating sheaths, i.e., sheaths whose apertures are dimensioned so that the coupling of energy through the sheath is increased along the length of the cable to compensate for attenuation of the signal within the cable.

From the foregoing, it should be apparent that the radiating cable of the invention may take the form of numerous, different embodiments. The crucial feature in all embodiments is the requirement of a plurality, i.e., more than one, of coaxial radiating sheaths. Though the cable of the invention has been illustrated using longitudinally pulled (cigarette-wrapped) metal tapes with longitudinal gaps and helically wound metal tapes with helical gaps, those of skill in the art will appreciate that virtually any structure which functions as a radiating sheath may be used in forming a cable in accordance with the invention. By radiating sheath is meant a structure which serves to couple radio frequency energy between the path inside the sheath and the path outside the sheath.

The presence of the plurality of radiating sheaths in the radiating cable of the invention remarkably decreases the attenuation of the internal TEM signal while providing radiation levels equivalent to conventional radiating coaxial cables. Hence, unamplified signals may be transmitted further along lines employing the cable of the invention than heretofore possible with conventional radiating coaxial cable. The cable of the invention also, surprisingly, minimizes environmental sensitivity so that, unlike conventional radiating coaxial cable, it functions uniformly in different installation environments. Finally, the cable of the invention reduces moisture ingression due to the fact that the additional layers of radiating sheaths and dielectrics constitute additional barriers to water penetration. This is particularly true if the radiating sheaths consist of laminated metal tapes in which the metal is bonded to a layer of plastic which is adhesively bonded to the adjacent layer in the cable.

To further illustrate the advantages of the cable of the invention, the following examples are provided. However, it is understood that their purpose is entirely illustrative and in no way intended to limit the scope of the invention.

EXAMPLE I

To compare the attenuation of the energy transmitted within radiating cables prepared in accordance with the invention with conventional radiating and nonradiating coaxial cables, two triaxial radiating cables, A and B having two radiating sheaths, were prepared as follows:

Cable A was manufactured by extruding a 0.450 in. diameter polyethylene foam over a 0.175 in. diameter copper-clad aluminum center conductor. The inner coaxial radiating sheath was then formed by a 1.125×0.003 in. cigarette-wrapped copper tape, leaving an approximately 0.29 in. wide longitudinal gap exposing the polyethylene dielectric core. An intermediate dielectric approximately 0.02 in. thick was formed over the inner radiating sheath by helically taping a 0.01 in. thick polyethylene tape, overlapping the tape for half its width. The outer coaxial radiating sheath was then formed by a 1.375×0.003 in. cigarette-wrapped copper tape, positioned such that the longitudinal gap formed by the tape was opposite the longitudinal gap in the inner radiating sheath. An outer jacket was supplied by two, one-half lap helical tapes having a total thickness of 0.007 in., which was adequate for test purposes.

Cable B was manufactured by extruding a 0.503 in. diameter unfoamed polyethylene over a 0.142 in. diameter copper-clad aluminum center conductor. The inner coaxial radiating sheath was then formed by a 1.125×0.003 in. cigarette-wrapped copper tape, leaving an approximately 0.455 in. wide longitudinal gap exposing the polyethylene dielectric core. An intermediate unfoamed polyethylene dielectric approximately 0.02 in. thick was extruded over the inner radiating sheath and in the gap. The outer coaxial radiating sheath was then foamed by a 1.375×0.003 in. cigarette-wrapped copper tape, positioned such that the longitudinal gap formed by the tape was opposite the longitudinal gap in the inner radiating sheath. The outer longitudinal gap in the outer coaxial sheath was 0.35 in. wide.

A slotted coaxial radiating cable, identified as cable X, was manufactured as a control. This cable was prepared in the same manner as Cable A without an outer coaxial radiating sheath or intermediate dielectric.

Three commercially marketed radiating coaxial cables manufactured under the trademark RADIAX by Andrew Corporation were also tested.

Transfer impedance and capacitive coupling impedance measurements were performed on the cable and confirmed that the radiation level was essentially the same for triaxial Cable A, coaxial Cable X and RADIAX Rx4-1. Triaxial Cable B and RADIAX Rx4-2A were also essentially the same in radiation level.

The attenuation results on the radiating cable labeled Cable X and RADIAX cables are typical of conventional radiating coaxial cables. Swept frequency measurements from 30 MHz to 900 MHz were performed. Measurements were performed with the samples suspended in the air and lying on the ground. In testing the triaxial cables, the two radiating sheaths were shorted together in a coaxial connector in the same manner as is conventionally done in testing non-radiating triaxial cable. The results are tabulated in Table I:

TABLE I

| Measured Attenuation of Cables Samples | | | | |
|---|---|---|---|---|
| | | Attenuation in db/100 Ft. | | |
| Cable | Condition | 30 MHz | 450 MHz | 900 MHz |
| B | on ground | 0.42 | 2.1 | 3.4 |
| | in air | 0.42 | 2.1 | 3.4 |
| RADIAX | on ground | 0.4 | 2.1 | 3.2 |
| Rx4-1 | in air | 0.4 | 1.9 | 2.9 |
| x | on ground | 0.56 | 3.0 | 5.7 |
| | in air | 0.5 | 2.45 | 4.0 |
| A | on ground | 0.38 | 1.85 | 2.9 |
| | in air | 0.38 | 1.85 | 2.8 |
| RADIAX | on ground | 0.42 | 2.9 | 5.3 |
| Rx4-2A | in air | 0.4 | 1.9 | 2.9 |
| RADIAX | on ground | 0.8 | 7.9 | 14.7 |
| Rx4-3A | in air | 0.4 | 1.9 | 3.0 |

The published nominal attenuation characteristics for RADIAX and theoretical nominal non-radiating cable performance are tabulated in Table II:

TABLE II

| Nominal Attenuation | | | | |
|---|---|---|---|---|
| | | Attenuation in db/100 Ft. | | |
| RADIAX | Condition | 30 MHz | 450 MHz | 900 MHz |
| Rx4-1 | Mounted directly to concrete or | 0.45 | 2.3 | 4.1 |

TABLE II-continued

| RADIAX | Condition | Nominal Attenuation Attenuation in db/100 Ft. 30 MHz | 450 MHz | 900 MHz |
|---|---|---|---|---|
| | other lossy surface | | | |
| | In free space | 0.45 | 2.1 | 3.2 |
| Rx4-2A | Mounted directly to concrete or other lossy surface | 0.5 | 3.2 | 6.4 |
| | In free space | 0.5 | 2.4 | 3.6 |
| Rx4-3A | Mounted directly to concrete or other lossy surface | 0.9 | 15.0 | 30.0 |
| | In free space | 0.9 | 4.0 | 6.0 |
| Theoretical Non-Radiating Cable A, x and RADIAX | Mounted on lossy surface | .4 | 1.9 | 2.9 |
| | In air or free space | .4 | 1.9 | 2.9 |
| Theoretical Non-Radiating Cable B | Mounted on lossy surface | .45 | 2.1 | 3.3 |
| | In air or free space | .45 | 2.1 | 3.3 |

A theoretical analysis of a uniform non-radiating transmission line shows that the propagation function ($\gamma$), which governs the manner in which the voltage and/or current vary with distance, is:

$$\gamma = \sqrt{(R + jwl)(G + jwc)}$$

where

R=the net effect of the conductors resistance l=the net effect of the conductors inductance G=the conductance which exists between the conductors c=the capacitance which exists between the conductors w=the angular frequency The theoretical attenuation of the signal propagating within the cable is the real part of the propagation function. The theoretical attenuation ($\alpha$) for a uniform, non-radiating coaxial cable with solid, cylindrical copper conductors, expressed in db/100 ft., is:

$$\alpha = (l/d + l/D)\frac{0.434}{Zo}\sqrt{f} + 2.77\,(\sqrt{\epsilon_r})\,d_f f$$

If wl>>R and wc>>G where d=center conductor outer diameter in inches

D=outer conductor inner diameter in inches

Zo=characteristic impedance in ohms $\epsilon_r$=relative dielectric constant $d_f$=dissipation factor f=frequency in megahertz The equation was used to obtain the theoretical non-radiating cable attenuations given in Table II.

These results show that the attenuation of the radiating coaxial cable, Cable X, and RADIAX, was up to 97% higher than what would be expected with a coaxial cable having a solid, cylindrical non-radiating outer conductor sheath. On the other hand, the attenuation of the cable samples prepared in accordance with the invention were within 10% of the theoretical values for a non-radiating coaxial sheath. This 10% variation is typical of what is obtained when non-radiating coaxial cable is measured and compared to the theoretical values.

EXAMPLE II

To compare the performance of cables prepared in accordance with the invention with conventional radiating cables in different environments, attenuation was measured for various cables at different frequencies in air, buried in sandy soil, immersed in a river and laying on the ground. Because the standard frequency range for radiating cables is between 30 and 900 MHz, swept frequency measurements were taken across this range. The environments with the highest and lowest results and the measured attenuation, at the indicated frequency appear in TABLE III:

TABLE III

| Cable | Condition | Attenuation in Various Environments Attenuation in db/100 Ft. 30 MHz | 450 MHz | 900 MHz |
|---|---|---|---|---|
| B | In water | 0.42 | 2.1 | 3.4 |
| | In air | 0.42 | 2.1 | 3.4 |
| RADIAX | In water | 0.4 | 2.1 | 4.4 |
| Rx4-1 | In air | 0.4 | 1.9 | 2.9 |
| x | In water | .62 | 7.9 | 34.0 |
| | In air | 0.5 | 2.45 | 4.0 |
| A | In water | 0.38 | 1.85 | 2.9 |
| | in air | 0.38 | 1.85 | 2.8 |
| RADIAX | In water | 0.39 | 3.9 | 14.0 |
| Rx4-2A | In air | 0.4 | 1.9 | 2.9 |
| RADIAX | On ground | 0.8 | 8.5 | 14.5 |
| Rx4-3A | In air | 0.4 | 1.9 | 3.0 |
| | In water | 0.5 | 14.0 | 52.0 |

These results demonstrate that while conventional radiating coaxial cables, that is, Cable X and RADIAX, are highly dependent on the environment, cables designed in accordance with the invention exhibit a relatively uniform, high performance in all environments. The higher attenuation at 30 MHz with Rx4-3A on the ground versus in water is not abnormal since the same characteristic has been measured on other conventional radiating coaxial cables. The phenomenon has also been measured at higher frequences.

While the invention has now been described in terms of certain preferred embodiments, and exemplified with respect thereto, those of skill in the art will readily appreciate that various modifications, changes, omissions and substitutions may be made without departing from the spirit of the invention. It is, therefore, intended that the invention be limited solely by the scope of the following claims.

What is claimed is:

1. A radiating cable comprising a center conductor, a cylindrical dielectric core surrounding said conductor, a first radiating sheath disposed along the length of said dielectric core surrounding said center conductor in coaxial relation to said center conductor, an intermediate dielectric layer surrounding said first radiating sheath, and a second radiating sheath disposed along the length of said intermediate dielectric layer in coaxial relation to said center conductor, wherein each of said first and second radiating sheaths is a tubular shaped metal tape having a longitudinal gap along its entire length and wherein said longitudinal gap in the tubular shaped metal tape of the first radiating sheath is positioned directly opposite the radial position of the longitudinal gap in the tubular shaped metal tape of the second radiating sheath.

2. A radiating cable comprising a center conductor, a cylindrical dielectric core surrounding said center conductor, a first radiating sheath disposed along the length of said dielectric core in coaxial relation to said center conductor, an intermediate dielectric layer surrounding said first radiating sheath, and a second radiating sheath disposed along the length of said intermediate dielectric layer in coaxial relation to said center conductor, wherein said first radiating sheath is a tubular shaped metal tape having a longitudinal gap along its entire length and said second radiating sheath is a non-overlapping helical metal tape.

3. The radiating cable as defined by claims 1 or 2, further comprising a protective jacket.

4. The radiating cable as defined by claim 3, wherein at least one of said radiating sheaths is provided with apertures which are dimensioned to achieve a grading effect, whereby the coupling of energy through the sheath is increased along the length of the cable to compensate for attenuation of the signal within the cable.

5. The radiating cable as defined by claim 3, wherein said metal tape is a metal laminate tape.

6. The radiating cable as defined by claim 3, wherein said metal tape contains an adhesive on at least one side which adheres it to at least one adjacent layer in said cable.

7. The radiating cable as defined by claim 3, wherein said radiating sheaths have at least one perturbing element associated therewith.

8. The radiating cable as defined by claim 3, wherein at least one of said radiating sheaths is corrugated.

9. A radiating cable comprising a center conductor, a dielectric core surrounding said conductor, and a plurality of radiating sheaths disposed along the length of said dielectric core, wherein each of said radiating sheaths is separated from the adjacent sheath by an intermediate layer of dielectric material and wherein at least one of said radiating sheaths is provided with apertures which are dimensioned to achieve a grading effect whereby the coupling of energy through the sheath is increased along the length of the cable to compensate for attenuation of the signal within the cable.

* * * * *